US008925436B2

(12) United States Patent
Yoshinuma et al.

(10) Patent No.: US 8,925,436 B2
(45) Date of Patent: Jan. 6, 2015

(54) SHEET CUTTING DEVICE AND IMAGE FORMING APPARATUS INCLUDING THE SHEET CUTTING DEVICE

(75) Inventors: Toshihiro Yoshinuma, Kanagawa (JP); Kazuhiro Wakamatsu, Kanagawa (JP); Masahiko Yamada, Tokyo (JP); Yuichiro Maeyama, Kanagawa (JP); Masato Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 440 days.

(21) Appl. No.: 13/366,427

(22) Filed: Feb. 6, 2012

(65) Prior Publication Data

US 2012/0222530 A1 Sep. 6, 2012

(30) Foreign Application Priority Data

Mar. 4, 2011 (JP) ..... 2011-047725

(51) Int. Cl.

| | |
|---|---|
| ***B26D 1/18*** | (2006.01) |
| ***B65H 35/00*** | (2006.01) |
| ***B26D 5/08*** | (2006.01) |
| ***B41J 11/70*** | (2006.01) |
| ***B26D 1/24*** | (2006.01) |
| ***B26D 7/26*** | (2006.01) |

(52) U.S. Cl.

CPC ..... *B41J 11/706* (2013.01); *B26D 1/185* (2013.01); *B26D 1/245* (2013.01); *B26D 7/2621* (2013.01); *B26D 7/2635* (2013.01)

USPC ..... 83/401; 83/488; 83/614

(58) Field of Classification Search

CPC ..... B41J 11/706; B41J 11/66; B41J 11/001; B26D 7/2635; B26D 1/245; B26D 1/185; B26D 7/2621; B26D 7/32

USPC ..... 83/401, 614, 488, 485, 487, 496, 659, 83/578, 481, 483, 509, 633, 676, 679, 205, 83/241, 263, 276; 400/621, 619; 399/363, 399/381

See application file for complete search history.

(56) References Cited

U.S. PATENT DOCUMENTS

| | | | | |
|---|---|---|---|---|
| 3,686,991 | A * | 8/1972 | Fujimoto | 83/482 |
| 4,590,834 | A * | 5/1986 | Sobel | 83/455 |

(Continued)

FOREIGN PATENT DOCUMENTS

| | | |
|---|---|---|
| CN | 2838890 | 11/2006 |
| CN | 101334594 | 12/2008 |

(Continued)

OTHER PUBLICATIONS

U.S. Appl. No. 13/293,517, filed Nov. 10, 2011.

(Continued)

*Primary Examiner* — Ghassem Alie
(74) *Attorney, Agent, or Firm* — Cooper & Dunham LLP

(57) ABSTRACT

A sheet cutting device includes a cutter holder, a moving unit, a connecting member, and a drawing member. The cutter holder accommodates a cutter. The cutter has opposed blades opposing each other to cut a sheet of recording media fed along a sheet feed path. The moving unit is disposed away from the cutter holder in a sheet feed direction in which the sheet is fed along the sheet feed path. The moving unit is reciprocally movable in a sheet width direction perpendicular to the sheet feed direction. The connecting member connects the cutter holder to the moving unit. The drawing member is mounted on the moving unit to draw the moving unit in the sheet width direction. The cutter holder is pivotable around the connecting member in a thickness direction of the sheet relative to the moving unit.

8 Claims, 13 Drawing Sheets

(56) References Cited

U.S. PATENT DOCUMENTS

| | | | | |
|---|---|---|---|---|
| 2002/0148337 | A1* | 10/2002 | Takabatake et al. | 83/614 |
| 2009/0000445 | A1 | 1/2009 | Yamamoto et al. | |
| 2009/0232577 | A1* | 9/2009 | Kumai | 400/621 |
| 2010/0071525 | A1* | 3/2010 | Chiang | 83/488 |
| 2011/0064497 | A1 | 3/2011 | Niihara et al. | |
| 2011/0211210 | A1 | 9/2011 | Niihara et al. | |
| 2013/0302077 | A1 | 11/2013 | Kumai | |

FOREIGN PATENT DOCUMENTS

| | | |
|---|---|---|
| CN | 101531010 | 9/2009 |
| JP | 8-206990 | 8/1996 |
| JP | 10-264086 | 10/1998 |
| JP | 2000-272117 | 10/2003 |
| JP | 2007-7967 | 1/2007 |
| JP | 3867779 | 1/2007 |
| JP | 2008-18606 | 1/2008 |
| JP | 2009-214200 | 9/2009 |

OTHER PUBLICATIONS

U.S. Appl. No. 13/306,029, filed Nov. 29, 2011.
U.S. Appl. No. 13/307,157, filed Nov. 30, 2011.
U.S. Appl. No. 13/352,591, filed Jan. 18, 2012.
U.S. Appl. No. 13/366,466, filed Feb. 6, 2012.
Chinese official action dated Jan. 10, 2014 in corresponding Chinese patent application No. 2012 10 05 2917.7.

* cited by examiner

SHEET CUTTING DEVICE AND IMAGE FORMING APPARATUS INCLUDING THE SHEET CUTTING DEVICE

CROSS-REFERENCE TO RELATED APPLICATION

This patent application is based on and claims priority pursuant to 35 U.S.C. §119 to Japanese Patent Application No. 2011-047725, filed on Mar. 4, 2011, in the Japan Patent Office, the entire disclosure of which is hereby incorporated by reference herein.

BACKGROUND

1. Technical Field

This disclosure relates to a sheet cutting device and an image forming apparatus including the sheet cutting device, and more specifically to a sheet cutting device to cut a rolled sheet to a desired length and an image forming apparatus including the sheet cutting device.

2. Description of the Related Art

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet. The image forming apparatus typically has a sheet cutting device to cut the rolled sheet to a desired length.

As the sheet cutting device, for example, JP2009-214200-A proposes a sheet cutting device that has a cutter assembly and guide rails. The cutter assembly has a cutter holder accommodating a cutter and a slider serving as a moving unit integrally molded with the cutter holder. The guide rails guide the slider slidably in the width direction of the rolled sheet. The cutter assembly cuts the rolled sheet while moving to one end in the width direction of the rolled sheet, and after cutting the sheet, the cutter assembly is returned to the other end in the width direction to prepare for the next sheet cutting. On the slider is mounted a drawing belt wound around a pulley of a cutter motor. Thus, a rotation driving force of the cutter motor is transmitted to the slider via the drawing belt to move the slider in the width direction of the rolled sheet.

In the sheet cutting device, after the cutting operation of the cutter ends, the cutter assembly is tilted toward the downstream side in the sheet feed direction around a guide member. As a result, the forward path along which the cutter moves to cut the rolled sheet differs from the backward path along which the cutter moves to retract after cutting the sheet. Such a configuration can prevent the cutter from contacting a subsequent one of divided sheets on the backward path, thus preventing a cut jam or other failure.

However, in the sheet cutting device, the cutter assembly is tilted between the forward path and the backward path, thus causing the drawing belt to twist between the slider and the pulley. As a result, each time the sheet cutting operation is performed, the drawing belt is repeatedly twisted, thus adversely affecting durability of the drawing belt.

BRIEF SUMMARY

In an aspect of this disclosure, there is provided a sheet cutting device including a sheet cutting device including a cutter holder, a moving unit, a connecting member, and a drawing member. The cutter holder accommodates a cutter. The cutter has opposed blades opposing each other to cut a sheet of recording media fed along a sheet feed path. The moving unit is disposed away from the cutter holder in a sheet feed direction in which the sheet is fed along the sheet feed path. The moving unit is reciprocally movable in a sheet width direction perpendicular to the sheet feed direction. The connecting member connects the cutter holder to the moving unit. The drawing member is mounted on the moving unit to draw the moving unit in the sheet width direction. The cutter holder is pivotable around the connecting member in a thickness direction of the sheet relative to the moving unit.

In another aspect of this disclosure, there is provided an image forming apparatus including an image forming device, a sheet feed device, and a sheet cutting device. The image forming device forms an image on a sheet of recording media. The sheet feed device feeds the sheet having the image formed thereon along a sheet feed path. The sheet cutting device cuts the sheet fed along the sheet feed path. The sheet cutting device includes a cutter holder, a moving unit, a connecting member, and a drawing member. The cutter holder accommodates a cutter. The cutter has opposed blades opposing each other to cut a sheet of recording media fed along a sheet feed path. The moving unit is disposed away from the cutter holder in a sheet feed direction in which the sheet is fed along the sheet feed path. The moving unit is reciprocally movable in a sheet width direction perpendicular to the sheet feed direction. The connecting member connects the cutter holder to the moving unit. The drawing member is mounted on the moving unit to draw the moving unit in the sheet width direction. The cutter holder is pivotable around the connecting member in a thickness direction of the sheet relative to the moving unit.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
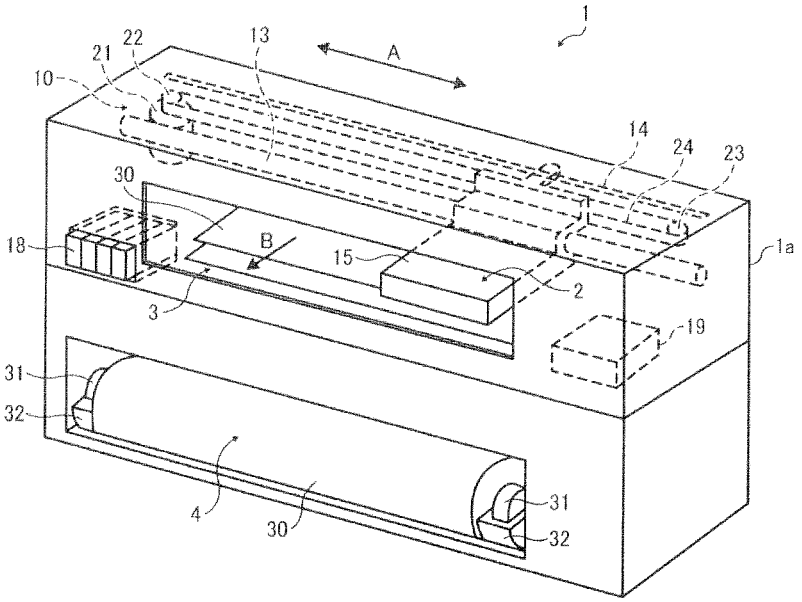
FIG. 1 is a schematic perspective view of an inkjet recording apparatus having a sheet cutting device according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIGS. 1 to 18 show a sheet cutting device and an image forming apparatus according to an exemplary embodiment of the present disclosure. In FIGS. 1 to 18, an inkjet recording apparatus is illustrated as an example of the image forming apparatus.

Figure 2:
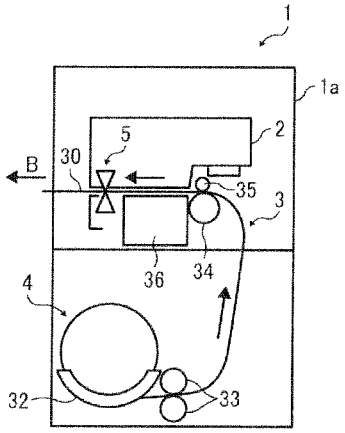
FIG. 2 is a schematic side view of the inkjet recording apparatus illustrated in FIG. 1.

In FIGS. 1 and 2, an inkjet recording apparatus 1 serving as the image forming apparatus is a serial-type inkjet recording apparatus that moves an inkjet recording head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image. It is to be noted that the image forming apparatus is not limited to the serial-type inkjet recording apparatus but may be, for example, a line-type inkjet recording apparatus having a recording head in which multiple nozzles are arranged across a substantially whole area in the width direction of a sheet to record an image on the sheet without scanning in the width direction.

The inkjet recording apparatus 1 includes an image forming section 2 serving as an image forming device, a sheet feed section 3 serving as a sheet feed device, a rolled sheet storage section 4, and a sheet cutting device 5. The image forming section 2, the sheet feed section 3, the rolled sheet storage section 4, and the sheet cutting device 5 are disposed within an apparatus main unit 1*a*.

In the image forming section 2, a guide rod 13 and a guide rail 14 extend between side plates, and a carriage 15 is supported by the guide rod 13 and the guide rail 14 so as to be slidable in a direction indicated by an arrow A in FIG. 1.

The carriage 15 mounts liquid ejection heads (recording heads) to eject ink droplets of different colors, e.g., black (K), yellow (Y), magenta (M), and cyan (C). Sub tanks are integrally molded with the corresponding recording heads to supply color inks to the respective recording heads.

A main scanning mechanism 10 moves the carriage 15 for scanning in a main scanning direction, that is, the sheet width direction indicated by the arrow A in FIG. 1. As illustrated in FIG. 1, the main scanning mechanism 10 includes a carriage driving motor 21 disposed at a first end in the sheet width direction, a driving pulley 22 rotated by the carriage driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, an encoder sheet is disposed along the sheet width direction in which the carriage 15 moves. An encoder sensor is disposed at the carriage 15 and reads the encoder sheet to detect the main scanning position of the carriage 15.

In a recording area of a main scanning region of the carriage 15, the rolled sheet 30 is intermittently fed by the sheet feed section 3 in a direction perpendicular to the sheet width direction, that is, a sheet feed direction indicated by an arrow B in FIG. 1.

Outside a movement range of the carriage 15 in the sheet width direction or at a first end side of the main scanning region of the carriage 15, main cartridges 18 are removably mounted to the apparatus main unit 1*a* to store the respective color inks to be supplied to the sub tanks of the recording heads. At a second end side of the main scanning region, a maintenance unit 19 is disposed to maintain and recover conditions of the recording heads.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposed ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumferences of the flanges 31 to feed the rolled sheet 30 to a sheet feed path.

As illustrated in FIG. 2, the sheet feed section 3 includes a pair of sheet feed rollers 33, a registration roller 34, a registration pressing roller 35, and a sheet suction feeding mechanism 36. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2.

The sheet suction feeding mechanism 36 is disposed below the image forming section 2 via the sheet feed path and performs suctioning operation to attract the rolled sheet 30 onto a platen at an upper face of the sheet suction feeding mechanism 36. Thus, the flatness of the rolled sheet 30 fed below the image forming section 2 is maintained.

After the rolled sheet 30 is fed from the rolled sheet storage section 4, the sheet feed section 3 feeds the rolled sheet 30 forward (toward the left side in FIG. 2) from the rear side (right side in FIG. 2) of the apparatus main unit 1*a* to the recording area below the image forming section 2. When the rolled sheet 30 is fed to the recording area, the carriage 15 reciprocally moves in the sheet width direction and the recording heads eject ink droplets in accordance with image information. In addition, while the rolled sheet 30 is intermittently fed forward, the recording heads repeatedly eject ink droplets onto the rolled sheet 30 to record lines of a desired image on the rolled sheet 30. Thus, the whole image is formed on the rolled sheet 30 in accordance with the image information.

After image formation, the sheet cutting device 5 cuts the rolled sheet 30 to a desired length and the cut sheet is discharged to a sheet output tray at the front side of the apparatus main unit 1*a*.

Next, the sheet cutting device 5 in this exemplary embodiment is described with reference to FIGS. 3 to 7.

Figure 3:
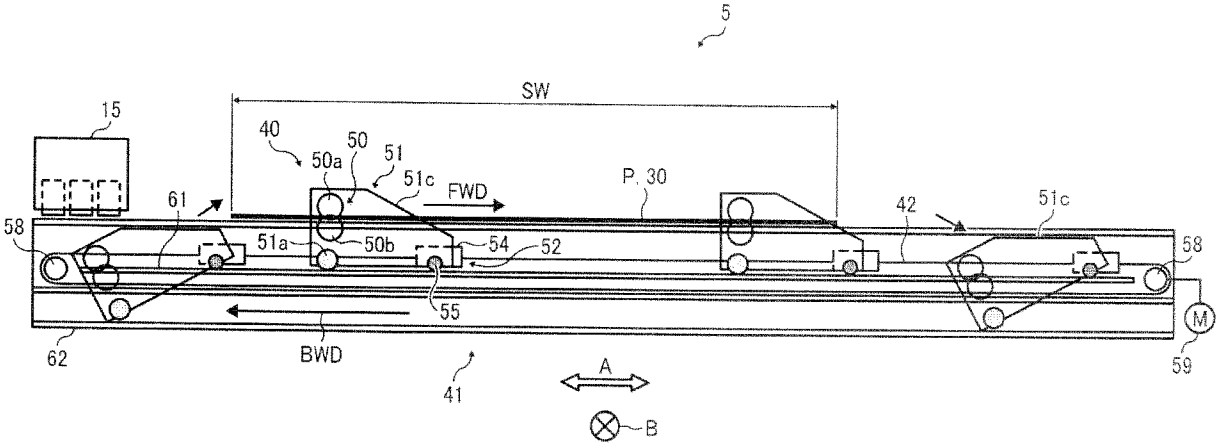
FIG. 3 is a schematic back view of the sheet cutting device illustrated in FIG. 1.

FIG. 3 is a schematic view of the sheet cutting device 5 seen from the back side of the apparatus main unit 1*a*.

Figure 4A:
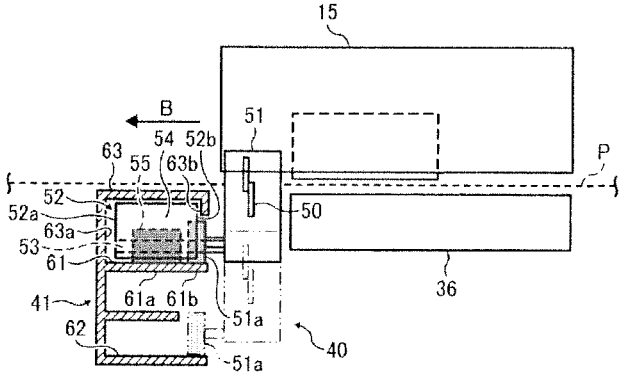
FIG. 4A is a partially cross-sectional side view of the sheet cutting device.
Figure 4B:
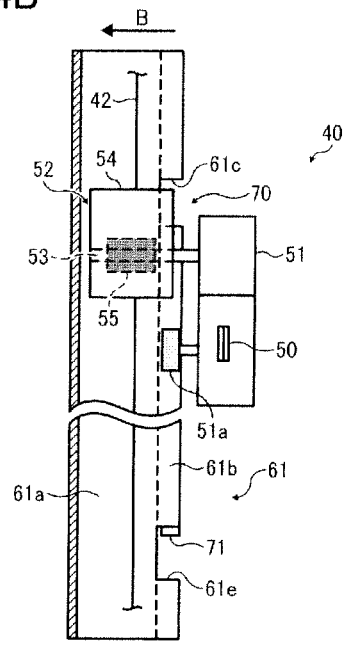
FIG. 4B is a partially cross-sectional plan view of the sheet cutting device.

As illustrated in FIGS. 3, 4A, and 4B, the sheet cutting device 5 is disposed downstream from the image forming section 2 in the sheet feed direction (see FIG. 2) and has a cutter assembly 40, a guide member 41, and a wire 42. The sheet cutting device 5 cuts the rolled sheet 30 fed along the sheet feed path to a desired length.

The cutter assembly 40 has a cutter holder 51 to accommodate a cutter 50, a moving unit 52, and a rotation shaft 53 serving as a connecting member.

The cutter 50 is formed with circular blades 50*a* and 50*b*. The circular blades 50*a* and 50*b* are disposed opposing each other and rotatably held by the cutter holder 51. With movement of the cutter holder 51 in the sheet width direction indicated by an arrow A in FIG. 3, the circular blades 50*a* and 50*b* receive a driving force to rotate. In other words, the cutter 50 rotates the circular blades 50*a* and 50*b* to cut the rolled sheet 30 and thus is capable of cutting, e.g., a relatively thick rolled sheet. The cutter 50 is also formed with the circular blades, thus preventing a failure, such as uneven wearing of a particular portion as in a stationary blade. It is to be noted that the number of circular blades is not limited to two and the cutter 50 may have a single circular blade or three or more circular blades. For example, in a case where the cutter 50 has a single circular blade, it is preferable to further provide a stationary linear blade extending in the moving direction of the cutter 50. In this exemplary embodiment, the circular blades 50*a* and 50*b* serve as blades of the cutter.

The cutter holder 51 can be reciprocally moved in the sheet width direction by the moving unit 52 and is connected to the moving unit 52 via the rotation shaft 53. The cutter holder 51 is also pivotable around the rotation shaft 53 in a thickness direction of the rolled sheet (hereinafter, sheet thickness direction) relative to the moving unit 53.

When the cutter holder 51 moves along a forward path (indicated by an arrow FWD in FIG. 3) from the second end side to the first end side of the apparatus main unit 1*a*, the cutter 50 cuts the rolled sheet 30. By contrast, when the cutter holder 51 moves along a backward path (indicated by an arrow BWD in FIG. 3) from the first end side to the second end side of the apparatus main unit 1*a*, the cutter holder 51 pivots downward relative to the moving unit 52 and returns to an initial position (hereinafter, home position) with the cutter holder 51 retracted from the sheet feed path downward in the sheet thickness direction, that is, the vertical direction. As a result, on the backward path, the cutter holder 51 is separated from the sheet feed path (indicated by a solid line P in FIG. 3) so as not to block the sheet feed path. When the cutter holder 51 returns from the backward path to the forward path, the cutter holder 51 rotates upward relative to the moving unit 52.

The cutter holder 51 is detected with detectors, e.g., micro switches 90 (see FIG. 15), disposed at opposed ends in the sheet width direction and controlled based on detection results of the detectors.

The cutter holder 51 has a driven roller 51*a* at an upstream side (left side in FIG. 3) in a direction in which the cutter holder 51 moves to cut the rolled sheet 30 (hereinafter, cutting direction).

The driven roller 51*a* is rotatably disposed away from a driving roller 55 in the sheet width direction. The driven roller 51*a* moves on an upper guide rail 61 along the forward path of the cutter holder 51 and on a lower guide rail 62 along the backward path. In other words, during movement of the cutter holder 51, the driven roller 51*a* serves as a positioning member (portion) to position the cutter holder 51 on the upper guide rail 61 and the lower guide rail 62. The positioning member of the cutter holder 51 is not limited to the driven roller 51*a* but may be, for example, a circular-arc protrusion.

As illustrated in FIGS. 4A and 4B, the moving unit 52 is disposed away from the cutter holder 51 in the sheet feed direction and has a main body 54 and the driving roller 55. The moving unit 52 is movable in the sheet width direction within a movement area extending in the sheet width direction of the apparatus main unit 1*a*.

As illustrated in FIGS. 3, 4A, and 4B, the driving roller 55 is made of, e.g., rubber and fixed at the rotation shaft 53 so as to be integrally rotatable with the rotation shaft 53. Thus, the driving roller 55 is rotatably held with the rotation shaft 53 relative to the main body 54 of the moving unit 52.

The moving unit 52 is connected to the wire 42 that is wound around a pair of pulleys 58 disposed at the opposed end sides of the apparatus main unit 1*a* in the sheet width direction. A first one of the pulleys 58 at the first end side of the apparatus main unit 1*a* is connected to a driving motor 59. As a result, the wire 42 circulates in the sheet width direction via the first one of the pulleys 58 rotated by the driving motor 59. In other words, the wire 42 transmits a drawing force to the moving unit 52. Thus, the wire 42 draws the moving unit 52 in the sheet width direction. As a result, the driving roller 55, while rotating, moves on the upper guide rail 61 with the circulation of the wire 42. In this exemplary embodiment, the wire 42 serves as a drawing member. The configuration of the moving unit 52 is further described below.

On switching the moving path between the forward path and the backward path, the cutter holder 51 pivots around the rotation shaft 53 of the driving roller 55 in the vertical direction. Thus, the cutter holder 51 switches between a first position with which, on the forward path, the cutter holder 51 cuts the rolled sheet 30 with the cutter 50 and a second position with which, on the backward path, the cutter holder 51 is retracted from the sheet feed path.

As illustrated in FIG. 4B, the driving roller 55 and the driven roller 51*a* are offset from each other in the sheet feed direction indicated by an arrow B. Specifically, the driven roller 51*a* is arranged upstream from the driving roller 55 in the sheet feed direction. As a result, with the driving roller 55 retained on the upper guide rail 61, the driven roller 51*a* is movable between the upper guide rail 61 and the lower guide rail 62, thus allowing the cutter holder 51 to pivot around the rotation shaft 53 of the driving roller 55. In FIG. 4A, a broken line P extending in the direction indicated by the arrow B represents the sheet feed path. In this exemplary embodiment, as illustrated in FIG. 4A, the cutter holder 51 is disposed within the width of the carriage 15 in the sheet feed direction. Alternatively, for example, the cutter holder 51 may be disposed away from the carriage 15 at the upstream or downstream side in the sheet feed direction.

As illustrated in FIG. 3, the cutter holder 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter holder 51 moves along the backward path.

As illustrated in FIGS. 4A and 4B, the rotation shaft 53 connects the cutter holder 51 to the moving unit 52. The driving roller 55 is fixed at an end portion of the rotation shaft 53 downstream in the sheet feed direction so as to be integrally rotatable with the rotation shaft 53. An end portion of the rotation shaft 53 upstream in the sheet feed direction is rotatably held by a bearing 51*b* of the cutter holder 51.

As illustrated in FIG. 3, the guide member 41 is a guide member to guide the movement of the moving unit 52 in the sheet width direction, and includes the upper guide rail 61 extending in the sheet width direction for a length that is at least longer than the width (sheet feed width) of the sheet feed path indicated by an arrow SW, and the lower guide rail 62 disposed away from the sheet feed path downward in the vertical direction. The upper guide rail 61 is disposed below the moving unit 52. As illustrated in FIG. 4A, the guide member 41 has an upper guide plate 63 above the upper guide rail 61. The upper guide plate 63 is disposed above the moving unit 52. The guide member 41 forms the forward path of the cutter holder 51 on the upper guide rail 61 and the backward path of the lower guide rail 62 on the lower guide rail 62. The driven roller 51*a* of the cutter holder 51 moves on the upper guide rail 61 along the forward path during cutting of the rolled sheet 30, and moves on the lower guide rail 62 along the backward path after cutting of the rolled sheet 30. In this exemplary embodiment, the upper guide rail 61 and the lower guide rail 62 are formed as a single member (the guide member 52). Alternatively, the upper guide rail 61 and the lower guide rail 62 may be formed as separate members. In this exemplary embodiment, the upper guide rail 61 serves as a first rail, and the upper guide plate 63 serve as a second rail.

As illustrated in FIGS. 4A and 4B, the upper guide rail 61 has a driving-roller guide area 61*a* to guide the driving roller 55 in the sheet width direction and a driven-roller guide area 61*b* to guide the driven roller 51*a* so that the cutter holder 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails.

Figure 6:
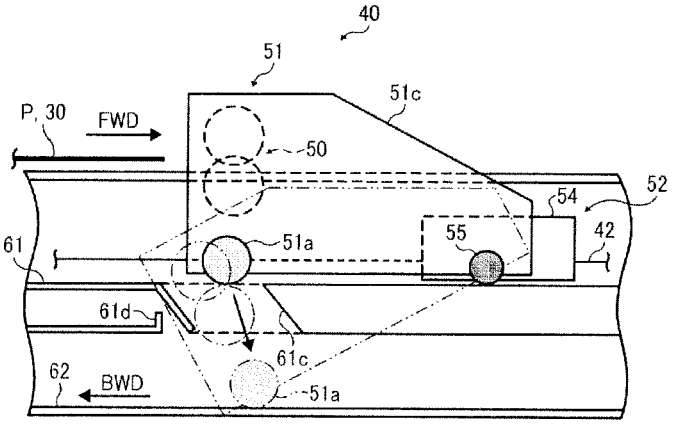
FIG. 6 is a schematic view of the cutter holder shifting to a backward path.

At a first end side of the driven-roller guide area 61*b* in the sheet width direction, a first connection path 61*c* is formed to switch the moving path of the cutter holder 51 from the forward path to the backward path. As illustrated in FIG. 6, the first connection path 61*c* is formed at the upper guide rail 61 so as to connect the forward path (indicated by an arrow FWD) on the upper guide rail 61 to the backward path (indicated by an arrow BWD) on the lower guide rail 62. Specifically, a portion of the upper guide rail 61 is cut out at the first end side in the sheet width direction and folded so as to slant downward at a certain angle, thus forming the first connection path 61*c*. Such a configuration allows the driven roller 51*a* to move from the upper guide rail 61 to the lower guide rail 62 after the rolled sheet 30 is cut with the cutter 50. A lower end portion 61*d* of the upper guide rail 61 adjacent to the first connection path 61*c* is folded upward so as not to contact the driven roller 51*a* moving along the backward path.

Figure 5:
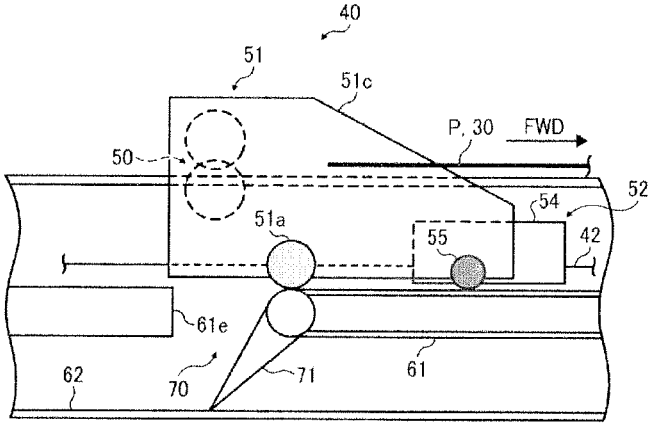
FIG. 5 is a schematic view of a cutter holder of the sheet cutting device having returned to a rolled-sheet cutting area.

As illustrated in FIG. 5, a moving mechanism 70 is disposed at a second end side of the driven-roller guide area 61*b* opposite the first end side in the sheet width direction. When the cutter holder 51 moves from the home position indicated by a solid line in FIG. 10 to the opposite end in the sheet width direction, the moving mechanism 70 shifts the driven roller 51*a* from the lower guide rail 62 to the upper guide rail 61, that is, returns the cutter holder 51 to a cutting area (rolled-sheet cutting area) of the rolled sheet.

The moving mechanism 70 includes a second connection path 61*e* connecting the backward path on the lower guide rail 62 to the forward path on the upper guide rail 61, and a switching hook 71 disposed adjacent to the second connection path 61*e* at the upper guide rail 61.

The second connection path 61*e* is formed by cutting out a portion of the upper guide rail 61 at the second end side in the sheet width direction (see FIG. 4B).

Figure 9:
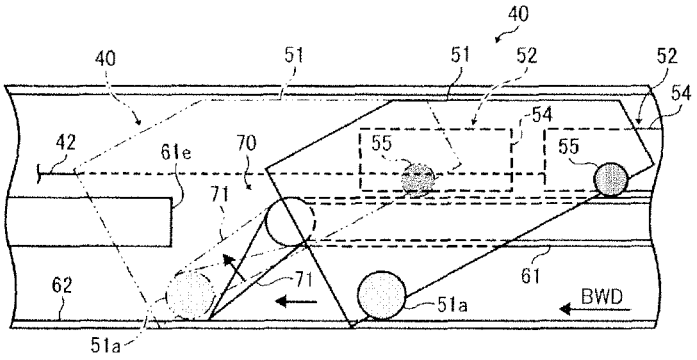
FIG. 9 is a schematic view of the cutter holder returning from the backward path to a home position.
Figure 10:
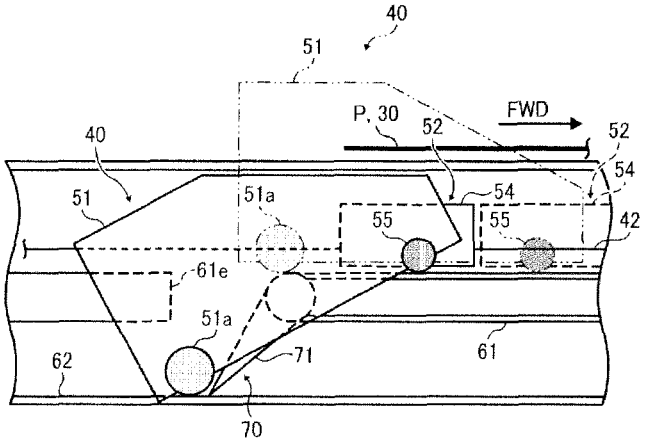
FIG. 10 is a schematic view of the cutter holder returning to the rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 9, when the cutter holder 51 moves along the backward path (indicated by an arrow BWD) to the second end side in the sheet width direction, the driven roller 51*a* contacts the switching hook 71 to pivot the switching hook 71 as indicated by a broken line. In this state, when the driven roller 51*a* further moves to the second end side in the sheet width direction, the switching hook 71 is separated from the driven roller 51*a* and returned by the urging member to an initial position, that is, a position indicated by a solid line in FIG. 9. At the initial position indicated by the solid line in FIG. 9, the switching hook 71 is tilted at a predetermined angle. Thus, as illustrated in FIG. 10, when the cutter holder 51 returns from the backward path to the forward path, the driven roller 51*a* can be moved from the lower guide rail 62 to the upper guide rail 61 via the switching hook 71. The switching hook 71 may be, for example, a leaf spring. In such a case, the urging member is not necessary.

The lower guide rail 62 guides the driven roller 51*a* of the cutter holder 51 while the cutter holder 51 moves along the backward path.

As illustrated in FIG. 4A, the upper guide plate 63 has a first guide face portion 63*a* and a second guide face portion 63*b* opposing paired side faces 52*a* and 52*b*, respectively, of the moving unit 52. The first guide face portion 63*a* is folded downward in L shape relative to the upper guide plate 63 and integrally connected to the upper guide rail 61. In this exemplary embodiment, the upper guide plate 63 and the upper guide rail 61 are integrally molded with the first guide face portion 63*a*. However, it is to be noted that the configuration of the upper guide plate 63 and the upper guide rail 61 is not limited to the above-described configuration but, for example, the upper guide plate 63 and the upper guide rail 61 may be separate members.

Like the first guide face portion 63*a*, the second guide face portion 63*b* is folded downward in L shape relative to the upper guide plate 63 and protrudes downward at a predetermined length. The predetermined length at which the second guide face portion 63*b* protrudes downward is a length sufficient to obtain an area contactable with contact portions 54*d* of the moving unit 52.

Next, operation of the sheet cutting device 5 is described with reference to FIGS. 5 to 10.

As illustrated in FIG. 10, before the rolled sheet 30 is cut, the cutter holder 51 is placed at the home position (indicated by the solid line in FIG. 10) at the second end side in the sheet width direction. When an instruction for sheet cutting is received, the driving roller 55 is rotated via the wire 42 (see FIG. 3). As a result, the driving roller 55, while rotating, moves from the cutter home position to the rolled-sheet cutting area (a position indicated by a broken line in FIG. 10), and then moves along the forward path (indicated by an arrow FWD in FIG. 10) to the first end side in the sheet width direction. At this time, the cutter 50 cuts the rolled sheet 30 with the movement of the cutter holder 51.

Figure 7:
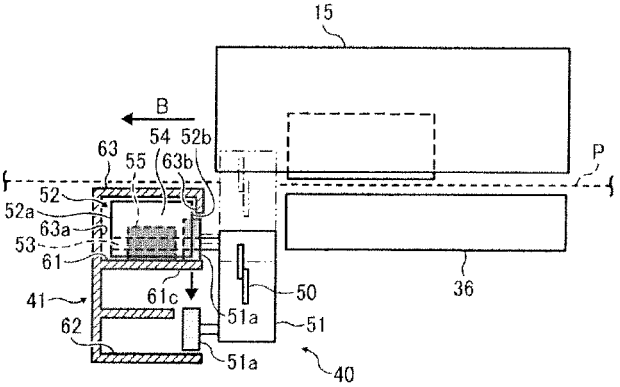
FIG. 7 is a partially cross-sectional side view of the cutter holder shifting to the backward path.

As illustrated in FIG. 6, when the cutter holder 51 moves along the forward path (indicated by the arrow FWD) to the first end side in the sheet width direction across the sheet feed path (indicated by a solid line P), the cutting of the rolled sheet 30 is finished. After the cutter holder 51 moves to the first end side in the sheet width direction, the cutter holder 51 pivots downward in the vertical direction around the rotation shaft 53 of the driving roller 55 (see FIG. 4A) under its own weight to switch the moving path from the forward path to the backward path. Specifically, when the driven roller 51*a* moving on the upper guide rail 61 arrives at the first connection path 51*c*, the driven roller 51*a* moves from the upper guide rail 61 to the lower guide rail 62 via the first connection path 61*c*. At this time, as illustrated in FIG. 7, with the driving roller 55 retained on the upper guide rail 61, only the driven roller 51*a* moves to the lower guide rail 62 under its own weight. As a result, in FIG. 7, the cutter holder 51 overlapping the sheet feed path indicated by a broken line P pivots to take a position with which the cutter holder 51 is movable along the backward path, that is, the position (indicated by a broken line in FIG. 6) with which the cutter holder 51 is retracted from the sheet feed path.

Figure 8:
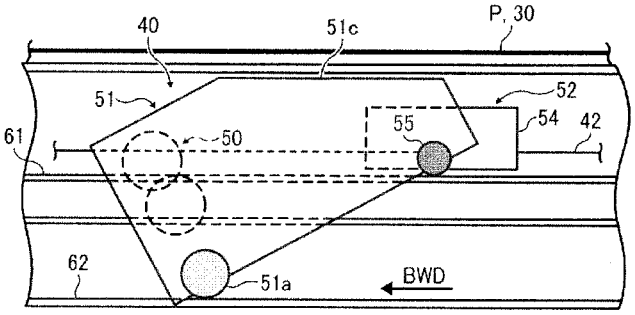
FIG. 8 is a schematic view of the cutter holder moving along the backward path.

Then, based on a position detected with a micro switch 90 (see FIG. 15) at the first end side in the sheet width direction, the wire 42 is circulated in reverse to rotate the driving roller 55 in reverse, that is, in a direction opposite a direction in which the driving roller 55 rotates on the forward path. Thus, as illustrated in FIG. 8, with the position retracted from the sheet feed path, the cutter holder 51 moves along the backward path (indicated by an arrow BWD) to the second end side in the sheet width direction. At this time, the slanted face 51*c* is parallel to the sheet feed path and, unlike on the forward path, the cutter holder 51 is retracted downward from the sheet feed path. Thus, while the cutter holder 51 moves along the backward path, the rolled sheet 30 can be fed along the sheet feed path, thus enhancing productivity. Such a configuration can also prevent the cutter 50 from contacting the rolled sheet 30 after cutting, thus preventing a cut jam or other failure.

As illustrated in FIG. 9, when the cutter holder 51 moves to the second end side in the sheet width direction and arrives at a position adjacent to the moving mechanism 70, the driven roller 51*a* contacts the switching hook 71. With the movement of the cutter holder 51, the driven roller 51*a* pushes up the switching hook 71 as indicated by the broken line in FIG. 9, and moves from the backward path side (the right side of the switching hook 71 in FIG. 9) to the second end side in the sheet width direction, that is, the side of the second connection path 61*e* (the left side of the switching hook 71 in FIG. 9). When the driven roller 51*a* moves to the side of the second connection path 61*e*, the switching hook 71 is separated from the driven roller 51*a* and returned by the urging member to the initial position, that is, the position indicated by the solid line in FIG. 9.

Thus, the reciprocal movement of the cutter holder 51 in the sheet width direction is finished. If the rolled sheet 30 is subsequently fed, the above-described reciprocal movement is repeated.

Next, the cutter holder 51 and the moving unit 52 in this exemplary embodiment are described with reference to FIGS. 11 to 16.

Figure 11A:
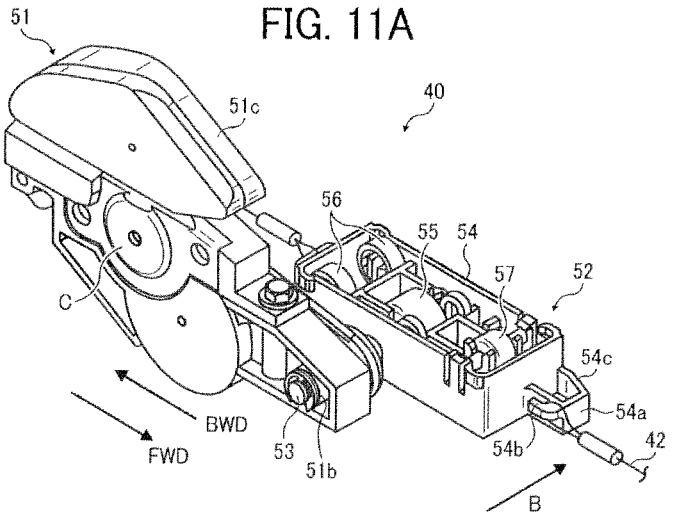
FIG. 11A is a perspective view of a cutter assembly seen from the back side.
Figure 11B:
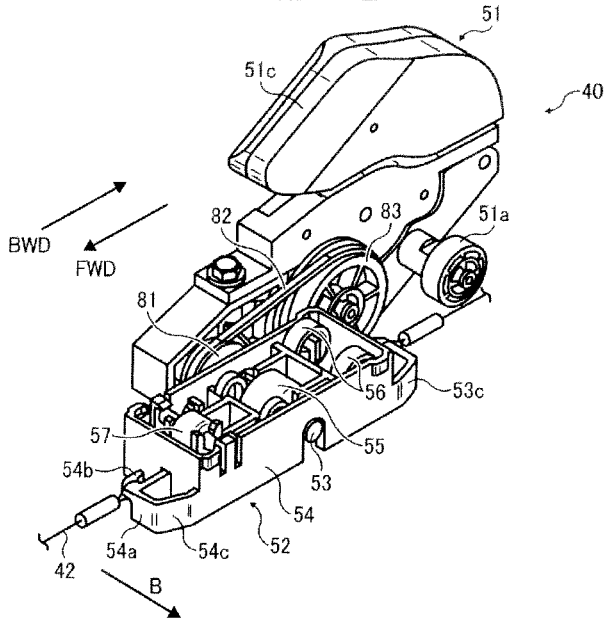
FIG. 11B is a perspective view of the cutter assembly seen from the front side.
Figure 12:
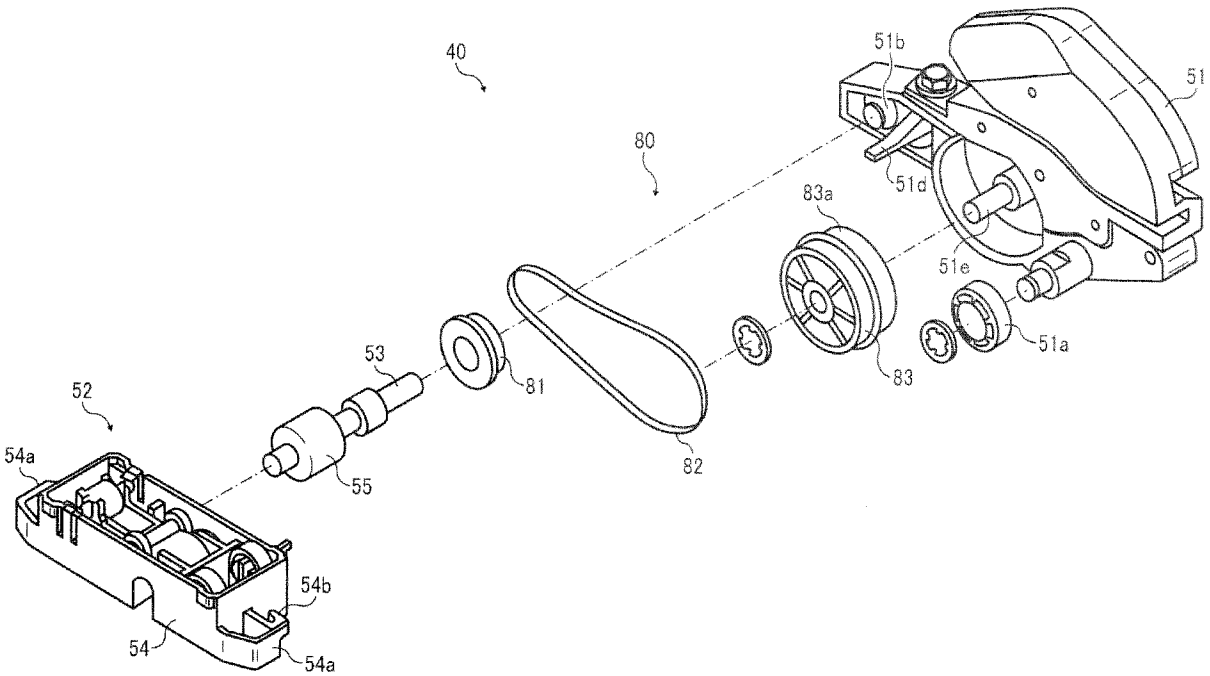
FIG. 12 is an exploded perspective view of the cutter assembly.

As illustrated in FIGS. 11A, 11B, and 12, the cutter holder 51 has a bearing 51*b* rotatably holding (supporting) the rotation shaft 53. In the cutter holder 51, the bearing 51*b* is disposed at a position downstream from the accommodated position C of the cutter 50 in the cutting direction, that is, the direction in which the cutter holder 51 moves to cut the rolled sheet 30 with the cutter 50 (the direction indicated by the forward path FWD in FIG. 11A), and lower than the accommodated position C of the cutter 50 in a height direction of the cutter holder 51. The cutter holder 51 is pivotably connected to the rotation shaft 53 via the bearing 51*b*.

As illustrated in FIG. 12, the cutter holder 51 has a stopper portion 51*d* protruding in the sheet feed direction (indicated by an arrow B in FIG. 11A). The stopper portion 51*d* engages a recessed portion 54*e* of the moving unit 52 with pivoting of the cutter holder 51.

The cutter holder 51 has a transmission unit 80 capable of transmitting a rotation driving force to the cutter 50. The transmission member 80 has a first pulley 81, an endless belt 82, and a second pulley 83.

The first pulley 81 is mounted on the rotation shaft 53 so as to be integrally rotatable with the rotation shaft 53. The second pulley 83 is rotatably mounted on a shaft 51*e* of the cutter holder 51. At an upstream side in the sheet feed direction, the second pulley 83 has a gear portion 83*a* engaging a gear disposed within the cutter holder 51. By engaging the gear, the gear portion 83*a* can transmit a rotation driving force to the cutter 50. The endless belt 82 is wound around the first pulley 81 and the second pulley 83.

Figure 13:
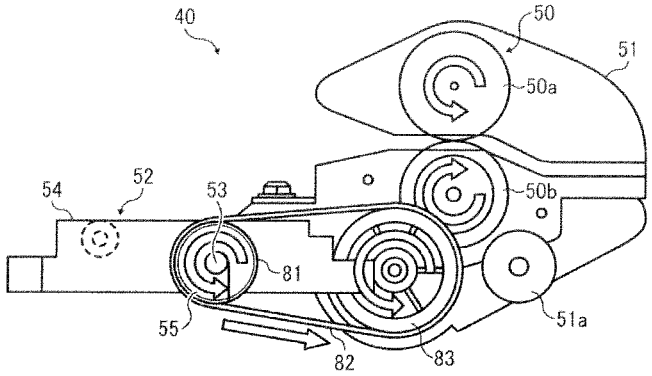
FIG. 13 is a schematic view of a transmission structure of a rotation driving force of a driving roller.

As a result, as illustrated in FIG. 13, with movement of the moving unit 52 in the sheet width direction, the driving roller 55 rotates and the rotation driving force of the driving roller 55 is transmitted to the cutter 50 via the rotation shaft 53, the first pulley 81, the endless belt 82, and the second pulley 83, thus rotating the circular blades 50*a* and 50*b*.

Figure 14:
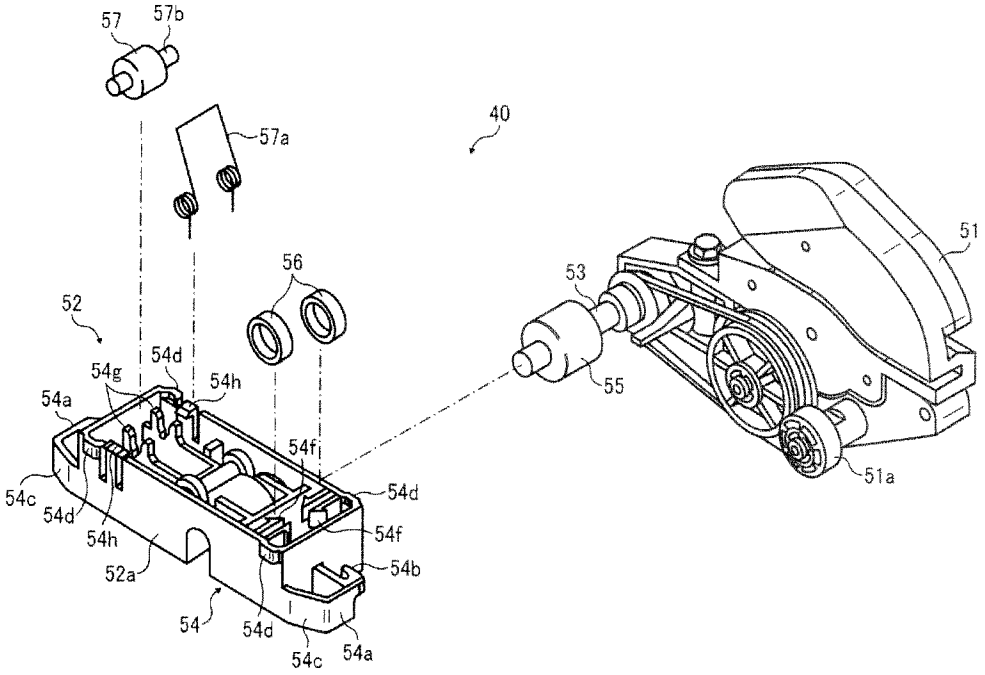
FIG. 14 is an exploded perspective view of a moving unit.

As illustrated in FIGS. 11A, 11B, and 14, besides the above-described main body 54 and driving roller 55, the moving unit 52 has auxiliary rollers 56, an urging roller 57, and an urging member 57*a*. In this exemplary embodiment, the driving roller 55 serves as a first rotation member. The auxiliary rollers 56 and the urging roller 57 form a second rotation member. The auxiliary rollers 56 also serve as a first roller, and the urging roller 57 also serves as a second roller.

The main body 54 of the moving unit 52 bears the rotation shaft 53 to rotatably hold (support) the driving roller 55. The rotation shaft 53 is rotatably mounted in the bearing 51*b* of the cutter holder 51. The main body 54 is movable in the sheet width direction between the upper guide rail 61 and the upper guide plate 63 (see FIGS. 4A and 4B).

Figure 15:
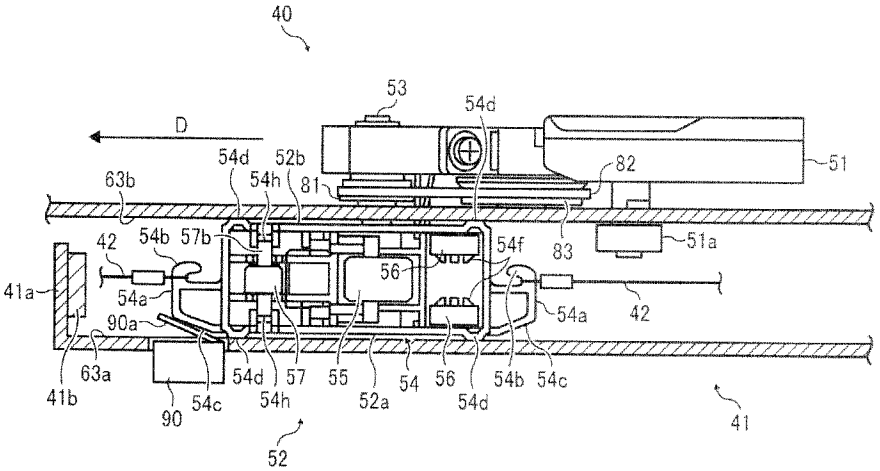
FIG. 15 is a plan view of a guide member held by the moving unit.

As illustrated in FIGS. 14 and 15, the main body 54 of the moving unit 52 has protruding portions 54*a* at upstream and downstream ends in the cutting direction indicated by an arrow D in FIG. 15 (both ends in the sheet width direction). Each of the protruding portions 54*a* shares a side face with the main body 54 and protrudes upstream or downstream in the cutting direction D. Each of the protruding portions 54*a* has a hook 54*b* to hook the wire 42 thereon.

Each of the protruding portions 54*a* has an inclined face 54*c* at a side face opposite a side face on which the hook 54*b* is mounted. The inclined face 54*c* is inclined at an angle so as to be contactable with a lever portion 90*a* of the micro switch 90. The micro switch 90 is mounted at the first guide face portion 63*a* so that the lever portion 90*a* is contactable with the inclined face 54*c*, thus detecting the moving unit 52. In this exemplary embodiment, the hook 54*b* is mounted on the protruding portion 54*a*. However, it is to be noted that the position of the hook 54*b* is not limited to such a position but, for example, the hook 54*b* may be mounted directly on the main body 54. Alternatively, the wire 42 may be directly on the main body 54.

The main body 54 has the contact portions 54*d* of a convex shape protruding outward at four upper positions on the side faces 52*a* and 52*b* opposing the first guide face portion 63*a* and the second guide face portion 63*b*. The contact portions 54*d* contact the first guide face portion 63*a* and the second guide face portion 63*b*. In this exemplary embodiment, the contact portions 54*d* have a convex shape. However, it is to be noted that the shape of the contact portions 54*d* is not limited to the convex shape but, for example, the contact portions 54*d* may be rollers.

Figure 16:
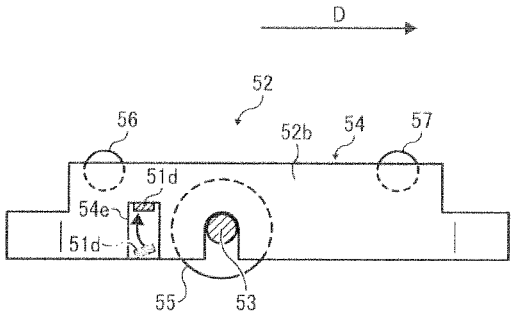
FIG. 16 is a side view of the moving unit seen from the cutter assembly side.

As illustrated in FIG. 16, the side face 52*b* of the main body 54 close to the cutter holder 51 has the recessed cutout portion 54*e* to receive the stopper portion 51*d* to prevent the cutter holder 51 from pivoting over a predetermined distance upward in the vertical direction. With pivoting of the cutter holder 51 upward in the vertical direction, the stopper portion 51*d* moves from a position indicated by a broken line in FIG. 16 to a position indicated by a solid line to contact an upper portion of the recessed portion 54*e*. As a result, further pivoting of the stopper portion 51*d* is regulated, thus preventing the cutter holder 51 from further pivoting upward. Thus, when the cutter holder 51 moves from the home position (indicated by the solid line in FIG. 10) to the rolled-sheet cutting area (indicated by the broken line in FIG. 10), the cutter holder 51 is regulated so as not to pivot upward from the rolled-sheet cutting area.

Figure 17:
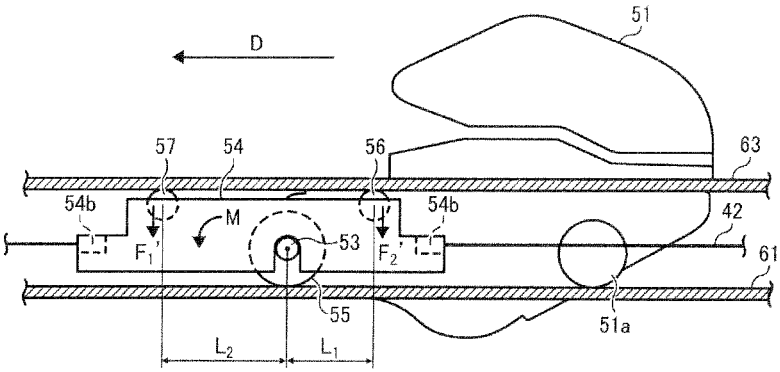
FIG. 17 is a side view of the driving roller, auxiliary rollers, and an urging roller.
Figure 18A:
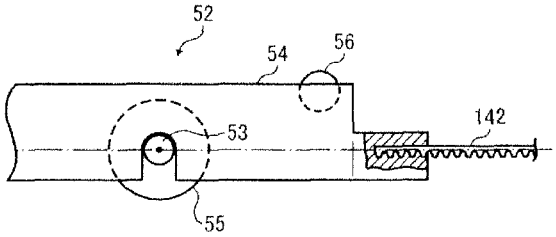
FIG. 18A is a partially cross-sectional side view of a moving unit mounting a timing belt instead of the wire.
Figure 18B:
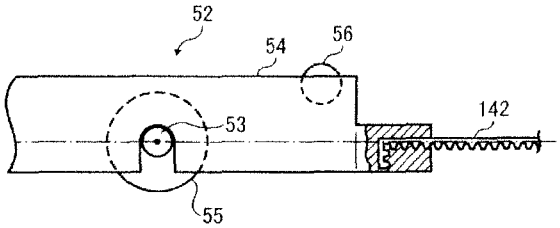
FIG. 18B is a partially cross-sectional side view of a moving unit mounting a timing belt in a way differing from that of FIG. 18A.

As illustrated in FIG. 17, the driving roller 55 is disposed at an upstream side of the main body 54 in the cutting direction D, i.e., at a side proximal to the auxiliary rollers 56 and rotates while contacting an upper face of the upper guide rail 61.

As illustrated in FIGS. 14 and 15, a pair of snap-fit portions 54*f* are disposed at upper portions of the main body 54 upstream in the cutting direction D so as to oppose each other in the sheet feed direction. The auxiliary rollers 56 are rotatably mounted on the pair of snap-fit portions 54*f*. In this exemplary embodiment, the auxiliary rollers 56 are two rollers. However, it is to be noted that the number of the auxiliary rollers 56 is not limited to two but, for example, a single auxiliary roller having a large width in the sheet feed direction may be employed.

The urging roller 57 has a roller shaft 57*b* and is rotatably mounted on bearings 54*g* via the roller shaft 57*b*. The bearings 54*g* are disposed at upper portions of the main body 54 downstream in the cutting direction D. The roller shaft 57*b* is held by the bearings 54*g* so as to be movable up and down in the bearings 54*g*. Stopping portions 54*h* are formed at inner sides of the side faces 52*a* and 52*b* in the sheet feed direction and prevent the roller shaft 57*b* from moving upward over a predetermined distance.

The urging member 57*a* is, e.g., a double torsion spring and has one end fixed at the main body 54 and the other end (free end) contacting the roller shaft 57*b* of the urging roller 57 from below. Thus, the urging member 57*a* urges the roller shaft 57*b* upward to press the urging roller 57 against a lower face of the upper guide plate 63 (see FIG. 17). In this exemplary embodiment, the auxiliary rollers 56 are disposed at the upstream side of the main body 54 in the cutting direction D and the urging roller 57 is disposed at the downstream side of the main body 54 in the cutting direction. However, it is to be noted that the arrangement of the auxiliary rollers 56 and the urging roller 57 is not limited to the above-described arrangement but the positions of the auxiliary rollers 56 and the urging roller 57 are interchangeable.

As illustrated in FIG. 17, the auxiliary rollers 56 and the urging roller 57 rotate while contacting the lower face of the upper guide plate 63. The urging roller 57 and each of the auxiliary rollers 56 are disposed away from each other in the sheet width direction (lateral direction in FIG. 17) so as to oppose across the driving roller 55.

Next, relationships among the driving roller 55, the auxiliary rollers 56, and the urging roller 57 are described below.

The auxiliary rollers 56 and the urging roller 57 are disposed away from the driving roller 55 by distances $L_1$ and $L_2$, respectively, in the sheet width direction. Here, the distances $L_1$ and $L_2$ have a relation of $L_1<_2$. Thus, the urging roller 57 is located further away from the driving roller 55 than the auxiliary rollers 56.

As the urging roller 57 is pressed against the upper guide plate 63 by an urging force $F_1$ of the urging member 57*a*, a reaction force $F_1'$ opposing the urging force $F_1$ acts on the main body 54 in a direction indicated by an arrow $F_1'$ in FIG. 17. As a result, a moment indicated by an arrow M in FIG. 17 is generated in the main body 54 rotating around the rotation shaft 53 of the driving roller 55. At this time, the moment M works to rotate the main body 54 counterclockwise in FIG. 17. However, contact of the auxiliary rollers 56 with the upper guide plate 63 prevents the main body 54 from being rotated by the moment M. In other words, the moment M presses the auxiliary rollers 56 against the upper guide plate 63 at a pressing force $F_2$. Thus, a reaction force indicated by an arrow $F_2'$ in FIG. 17 acts from the upper guide plate 63 onto the auxiliary rollers 56. As a result, the driving roller 55 is pressed against the upper guide rail 61 by the reaction force $F_1'$ and the reaction force $F_2'$. Thus, friction resistance arises between the driving roller 55 and the upper guide rail 61, thus allowing the driving roller 55 to rotate with the movement of the moving unit 52.

In this exemplary embodiment, because the distance $L_2$ is set to be longer than the distance $L_1$, the urging force $F_1$ of the urging member 57*a* can be relatively small. In other words, as the distance $L_2$ is longer, the urging force $F_1$ of the urging member 57*a* can be set to be smaller. By contrast, in a case where the distance $L_2$ is shorter, the urging force $F_1$ of the urging member 57*a* is set to be greater.

It is to be noted that the distances $L_1$ and $L_2$ are set in accordance with, e.g., the size of the main body 54. Therefore, the relation of the distances $L_1$ and $L_2$ is not limited to $L_1<L_2$ but may be $L_1>L_2$ or $L_1=L_2$, provided that at least the driving roller 55 is disposed between the auxiliary rollers 56 and the urging roller 57.

Next, buffer portions 41*b* of the guide member 41 are described with reference to FIG. 15.

As illustrated in FIG. 15, the guide member 41 has the flange portions 41*a* at opposed ends of the movement area of the moving unit 52 in the sheet width direction (lateral direction in FIG. 15). Each flange portions 41*a* is folded from a side face of the guide member 41 downstream in the sheet feed direction toward the upstream side in the sheet feed direction. Alternatively, each flange portion 41*a* may be folded upward from the upper guide rail 61.

On each flange portion 41*a*, the buffer portion 41*b* made of rubber is mounted so as to be contactable with an end of each of the protruding portions 54*a* of the main body 54. Such a configuration can absorb shock created when the moving unit 52 arrives at each end in the sheet width direction.

Of the movement area of the moving unit 52, although only the downstream side in the cutting direction D is illustrated in FIG. 15, the upstream side in the cutting direction D has a similar configuration. In other words, like a downstream end portion in the cutting direction D, the buffer portion 41*b* and the micro switch 90 are disposed at an upstream end portion in the cutting direction D.

As described above, in the sheet cutting device according to this exemplary embodiment, only the cutter holder 51 is pivotable around the rotation shaft 53 in the thickness direction of the sheet, relative to the moving unit 52 separately provided from the cutter holder 51. As a result, as the cutter holder 51 pivots around the rotation shaft 53, the moving unit 52 does not integrally pivot with the cutter holder 51, thus preventing a change in the position of the moving unit 52. Such a configuration can prevent twist of the wire 42 mounted on the moving unit 52, thus minimizing a reduction in durability of the wire 42.

In the sheet cutting device according to this exemplary embodiment, the driving roller 55 contacts the upper guide rail 61, and the auxiliary rollers 56 and the urging roller 57 contact the upper guide plate 63. Such a configuration can prevent the moving unit 52 from shaking in the thickness direction of the sheet when the moving unit 52 moves in the sheet width direction between the upper guide rail 61 and the upper guide plate 63, thus allowing stable movement of the moving unit 52.

In the sheet cutting device according to this exemplary embodiment, the auxiliary rollers 56 and the urging roller 57 contact the upper guide plate 63. Such a configuration can prevent the moving unit 52 from rotating in the thickness direction of the sheet when the moving unit 52 moves in the sheet width direction, thus allowing stable movement of the moving unit 52.

In the sheet cutting device according to this exemplary embodiment, the driving roller 55 rotates with movement of the moving unit 52, thus allowing a rotation driving force to be transmitted to the cutter 50 via the rotation shaft 53 and the transmission member 80. Thus, the sheet cutting device according to this exemplary embodiment can transmit the rotation driving force to the cutter 50 in a simple configuration.

In the sheet cutting device according to this exemplary embodiment, the urging member 57*a* urges the urging roller 57 against the upper guide plate 63, thus pressing the driving roller 55 against the upper guide rail 61. As a result, friction arises between the driving roller 55 and the upper guide rail 61, thus allowing the driving roller 55 to obtain the rotation driving force.

In the sheet cutting device according to this exemplary embodiment, the contact portions 54*d* contact the first guide face portion 63*a* and the second guide face portion 63*b*, thus preventing the moving unit 52 from tilting or shaking in the sheet feed direction when the moving unit 52 moves in the sheet width direction, thus allowing stable movement of the moving unit 52.

In the sheet cutting device according to this exemplary embodiment, the recessed portion 54*e* receives the stopper portion 51*d*, thus preventing the cutter holder 51 from pivoting upward in the thickness direction of the sheet over a predetermined distance.

In the sheet cutting device according to this exemplary embodiment, the moving unit 52 has the inclined faces 54*c* inclined at a predetermined angle relative to the side face 52*a*, thus allowing precise operation of the micro switch 90.

In this exemplary embodiment, the wire 42 is employed as the drawing member to draw the moving unit 52. However, it is to be noted that the drawing member is not limited to the wire 42 but may be, for example, an open-ended timing belt 142 illustrated in FIGS. 18A and 18B. In such a case, end portions of the timing belt 142 are fixed at the main body 54 of the moving unit 52 so as not to accidentally detach from the main body 54. In an example illustrated in FIG. 18B, an end portion of the timing belt 142 is folded in L shape and fixed at the main body 54 of the moving unit 52, thus more reliably preventing accidental detachment of the timing belt 142 than another example illustrated in FIG. 18A. Use of the timing belt 142 can also further reduce slippage in drawing the moving unit 52 as compared to the wire 42. Additionally, in the above-described case where the timing belt 142 is employed as the drawing member, such a configuration can prevent the timing belt 142 from being twisted when the position of the cutter holder 51 shifts, thus minimizing a reduction in durability of the timing belt 142. In this regard, in the case where the timing belt 142 having a flat face, twist of the timing belt 142 might more adversely affect the durability of the timing belt 142 than the wire 42. Therefore, in the case where the timing belt 142 is employed as the drawing member, the configuration of this exemplary embodiment has greater effects than the case where the wire 42 is employed.

Figure 19:
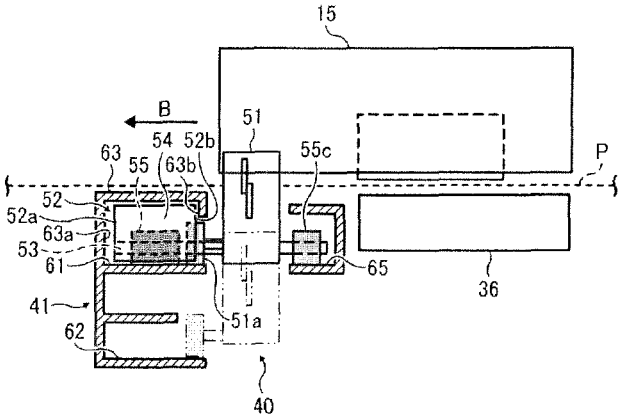
FIG. 19 is a schematic side view of a sheet cutting device according to another exemplary embodiment of this disclosure.

In this exemplary embodiment, as illustrated in FIGS. 4A and 4B, the driving roller 55 is disposed at only one side of the cutter holder 51, that is, the downstream side of the cutter holder 51 in the sheet feed direction B. However, it is to be noted that the configuration of the driving roller 55 is not limited to the above-described configuration but, for example, as illustrated in FIG. 19, besides the driving roller 55, another driving roller 55*c* may be disposed at a side opposite the side at which the driving roller 55 is disposed. In other words, the driving roller 55 and the driving roller 55*c* may be disposed facing each other across the cutter holder 51. In such a case, besides the upper guide rail 61 at the downstream side in the sheet feed direction, another guide rail 65 is disposed corresponding to the driving roller 55*c*.

In this exemplary embodiment, the cutter holder 51 is retracted downward in the vertical direction. However, it is to be noted that the configuration of the cutter holder 51 is not limited to the above-described configuration but, for example, in a case where the sheet cutting device 5 is not horizontally disposed relative to the apparatus main unit 1*a*, the cutter holder may be retracted in the thickness direction of the rolled sheet 30 in accordance with the inclination of the sheet cutting device 5. Alternatively, the cutter holder may be retracted upward in the vertical direction. In such a case, the guide member is disposed above the sheet feed path, the forward path of the cutter holder is disposed on the lower guide rail, and the backward path is disposed on the upper guide rail. As a result, after the cutter holder moves along the forward path to cut the rolled sheet, the driven roller shifts onto the upper guide rail via a moving mechanism corresponding to the moving mechanism 70 of the above-described exemplary embodiment. Thus, the cutter holder is retracted from the sheet feed path so as to be movable along the backward path. After the cutter holder moves along the backward path, the driven roller shifts onto the lower guide rail via a communication path corresponding to the first connection path 61*c* of the above-described exemplary embodiment. Thus, the cutter holder takes a position for cutting the rolled sheet. Such a configuration can obtain effects equivalent to the effects of the above-described exemplary embodiment.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet cutting device comprising:

a cutter holder accommodating a cutter, the cutter having opposed blades opposing each other to cut a sheet of recording media fed along a sheet feed path:

a moving unit disposed away from the cutter holder in a sheet teed direction in which the sheet is fed along the sheet feed path, the moving unit reciprocally movable in a sheet width direction perpendicular to the sheet feed direction:

a connecting member connecting the cutter holder to the moving unit;

a drawing member mounted on the moving unit to draw the moving unit in the sheet width direction, wherein the cutter holder is pivotable around the connecting member in a thickness direction of the sheet relative to the moving unit; and a guide member disposed along the sheet width direction to guide the moving unit in the sheet width direction, the guide member having a first rail under the moving unit and a second rail above the moving unit, wherein the moving unit has a first rotation member rotatable white contacting the first rail and a second rotation member rotatable while contacting the second rail.

2. The sheet cutting device according to claim 1, wherein the second rotation member comprises a first roller and a second roller disposed away from each other in the sheet width direction and opposing each other across the first rotation member.

3. The sheet cutting device according to claim 2, wherein the moving unit has an urging member that urges at least one of the first roller and the second roller against the second rail.

4. The sheet cutting device according to claim 1, wherein the cutter holder has a transmission member being able to transmit a rotation driving force to the cutter, the connecting member is connected to the transmission member and able to transmit a rotation driving force to the transmission member, and the first rotation member is fixed at the connecting member and integrally rotatable with the connecting member.

5. The sheet cutting device according to claim 1, wherein the second rail has a first guide face portion and a second guide face portion opposing a first side face and a second side face, respectively, of the moving unit, the first side face and the second side face of the moving unit opposing each other in the sheet feed direction, and the moving unit has contact portions that contact the first guide face portion and the second guide face portion.

6. The sheet cutting device according to claim 1, wherein one of the cutter holder and the moving unit has a stopper portion protruding in the sheet feed direction and the other of the cutter holder and the moving unit has a recessed cutout portion to receive the stopper portion to prevent the cutter holder from pivoting upward in the thickness direction of the sheet over a predetermined distance.

7. The sheet cutting device according to claim 1, further comprising micro switches to detect the moving unit, wherein the moving unit has protruding portions at opposed ends thereof in the sheet width direction, each of the protruding portions has an inclined face inclined at an angle so as to contact a corresponding one of the micro switches.

8. The sheet cutting device according to claim 7, wherein the guide member has buffer members contactable with the protruding portions at opposed ends of a movement area of the moving unit in the sheet width direction.

* * * * *